US007740498B1

(12) United States Patent
Orsley

(10) Patent No.: US 7,740,498 B1
(45) Date of Patent: Jun. 22, 2010

(54) ADVANCED BACKWARD COMPATIBLE CONNECTOR ASSEMBLY FOR ELECTRICALLY CONNECTING COMPUTER SUBSYSTEMS

(75) Inventor: Tim Orsley, San Jose, CA (US)

(73) Assignee: Seagate Technology LLC, Scotts Valley, CA (US)

( * ) Notice: Subject to any disclaimer, the term of this patent is extended or adjusted under 35 U.S.C. 154(b) by 920 days.

(21) Appl. No.: 11/201,862

(22) Filed: Aug. 11, 2005

Related U.S. Application Data

(63) Continuation of application No. 10/165,536, filed on Jun. 7, 2002, now Pat. No. 6,942,511.

(51) Int. Cl.
*H01R 27/00* (2006.01)

(52) U.S. Cl. ..... 439/218; 439/660; 439/680

(58) Field of Classification Search ..... 439/60, 439/924.1, 217, 218, 948, 222, 680, 108, 439/608, 65, 660
See application file for complete search history.

(56) References Cited

U.S. PATENT DOCUMENTS 4,084,875 A * 4/1978 Yamamoto ..... 439/274
5,174,770 A * 12/1992 Sasaki et al. ..... 439/108
5,581,127 A * 12/1996 Shinohara ..... 257/679
5,591,035 A * 1/1997 Burkholder et al. ..... 439/79
5,660,551 A * 8/1997 Sakurai ..... 439/108

* cited by examiner

*Primary Examiner*—Felix O Figueroa
(74) *Attorney, Agent, or Firm*—Hensley Kim & Holzer, LLC

(57) ABSTRACT

A backward compatible connector assembly that facilitates electrical communication between computer subsystems includes a receptacle, a receiver assembly and a conductor array. The receptacle includes a plurality of first connectors having a first connector length, and a plurality of interspersed second connectors having a second connector length that differs from the first connector length. The first connectors include data pins and the second connectors can include ground pins for single-ended signaling. Alternatively, the second connectors can include a plurality of data pins to form differential pairs of connectors for low voltage differential signaling. The receiver assembly includes first connector receivers that receive the first connectors, and second connector receivers that receive the second connectors. The conductor array can include approximately 40 signal-bearing conductors that have interspersed ground lines or signal-bearing lines. The first connector receivers have a first receiver depth that is different than a second receiver depth of the second connector receivers. The connector assembly can include 40 first connectors and first connector receivers, and 38 second connectors and second connector receivers.

25 Claims, 9 Drawing Sheets

ADVANCED BACKWARD COMPATIBLE CONNECTOR ASSEMBLY FOR ELECTRICALLY CONNECTING COMPUTER SUBSYSTEMS

REFERENCE TO RELATED APPLICATION

The present application is a continuation application of U.S. patent application Ser. No. 10/165,536, filed on Jun. 7, 2002 now U.S. Pat. No. 6,942,511. The present application claims priority on co-pending U.S. patent application Ser. No. 10/165,536 under 35 U.S.C. §120. To the extent permitted, the contents of U.S. patent application Ser. No. 10/165,536 are incorporated herein by reference.

FIELD OF THE INVENTION

The present invention relates generally to computer system arrays. More specifically, the present invention relates to an interface between computer subsystems.

BACKGROUND

The use of connector assemblies to facilitate data communication between computer subsystems is well known. A typical connector assembly can include a receiver assembly having two female sets of connector receivers, one on either end of a plurality of parallel, insulated conductor lines. Further, the connector assembly includes two receptacles. Each receptacle is normally included as part of a separate computer subsystem, and each includes a plurality of spaced-apart male connector pins (also referred to herein as connectors). The connectors of one receptacle each mate with a corresponding connector receiver on one end of the receiver assembly, while the connector pins of the other receptacle each mate with corresponding connector receiver on the other end of the receiver assembly. Once connected, the connector assembly forms an electrical pathway for data to be transferred from one computer subsystem to another. A detailed description of an example of a connector assembly is provided in U.S. Pat. Nos. 5,928,028 and 5,997,346, issued to Orsley et al. U.S. Pat. Nos. 5,928,028 and 5,997,346 are incorporated herein by this reference.

One type of connector assembly includes a receptacle having 40 connectors, and a receiver assembly having 40 connector receivers on each end of the receiver assembly. This type of connector assembly utilizes the well-established 40-contact Advanced Technology Attachment (ATA) or Advanced Technology Attachment Packetized Interface (ATAPI) specification. For example, this type of connector assembly can be used to couple a hard disk drive to a hard disk drive port of a computer system. Over the years, the 40-connector pin/40-connector receiver specification (the 40/40 connector assembly), including the location, dimension and signal assignment of each pin, has become one of the familiar configurations in the computer industry. As used herein, the term "legacy" refers to the standard, conventional components of the 40/40 connector assembly, such as connector pins and connector receivers.

For relatively slow ATA or ATAPI data transfer rates, standard receiver assemblies (i.e., those having signal-bearing conductors disposed immediately adjacent to one another) work adequately. However, when the data transfer rates increase, e.g., to facilitate communication between high performance subsystems or during data bursts between even relatively slow subsystems, inductive cross-talk between adjacent signal-bearing connectors of the connector assembly can degrade the signals thereon. If the inductive cross-talk is excessive, some of the data being transmitted may be corrupted. Additionally, in standard 40/40 connector assemblies, the degraded signals caused by inductive cross-talk can decrease the speed of data transmission.

Ground conductors interspersed between the signal-bearing conductors in the cable can reduce the inductive cross-talk between adjacent signal-bearing conductors. By shielding the signal-bearing conductors from one another, inductive cross-talk is reduced, thereby permitting data communication to take place at a relatively high rate and/or increasing the signal-to-noise ratio of the data transmitted.

Conceptually, it may be a relatively simple matter to increase the number of connector pins in a given connector assembly such that every other connector pin is non signal-bearing and grounded, thereby creating an interspersed ground connector assembly. However, the coupling of connector pins with the receiver assembly which may or may not have an equal number of connector receivers has, up to now, presented a backward compatibility problem. This is because, as mentioned earlier, the number, location, dimension, and signal assignment of each connector and each connector receiver typically conforms to a predetermined specification. Because of this widely used specification, any attempt to alter the number of connectors or connector receivers could cause substantial compatibility problems between computer subsystems. For example, a connector assembly having an increased number of typical connector pins would not be compatible with a ribbon cable having the standard 40-receiver configuration. Conversely, a connector assembly having a standard 40-connector array may not be suited to mate with a receiver assembly having an increased number of connector receivers. Stated another way, modification to the connector assembly to decrease inductive cross-talk and/or increase burst transfer rates may result in a lack of backward compatibility, which could adversely affect millions of systems, and can make the transition to an improved connector scheme more difficult.

In light of the above, the need exists to provide an interface between computer subsystems that can facilitate an increased burst transfer rate during data transfer between the subsystems. Another need exists to provide a connector assembly that provides backward compatibility despite having a disparate number of connectors and connector receivers. Still another need exists to provide a disk drive having a conductor array that satisfies these needs and is relatively easy and inexpensive to manufacture.

SUMMARY

The present invention is directed to a connector assembly for a computer subsystem array that includes a first computer subsystem and a second computer subsystem. The connector assembly facilitates electrical communication between the computer subsystems. In one embodiment, the connector assembly includes a receptacle that is electrically connected to one of the computer subsystems. The receptacle includes a plurality of spaced-apart first connectors having a first connector length, and a plurality of spaced apart second connectors having a second connector length that differs from the first connector length. For example, the receptacle can include approximately 40 first connectors and approximately 38 second connectors.

In one embodiment, the first connectors are positioned in two rows, each row having approximately 20 substantially collinear first connectors. Each row of first connectors is substantially collinear with a corresponding row of second connectors. The second connectors can be interspersed between the first connectors so that each of the second connectors is positioned substantially between a corresponding pair of the first connectors.

In another embodiment, a plurality of the first connectors are data pins and each of the second connectors is a ground pin. Alternatively, one or more of the first connectors can be a data pin and one or more of the second connectors can also be a data pin. The second connectors that are data pins can each be positioned adjacent to a corresponding first connector that is also a data pin.

In yet another embodiment, the connector assembly includes a receiver assembly that receives at least a portion of the first connectors. The receiver assembly can include a plurality of spaced apart first connector receivers that receive the first connectors and/or a plurality of spaced apart second connector receivers that receive the second connectors. The number of first connector receivers can be approximately equal to the number of first connectors, and the number of second connector receivers can be approximately equal to the number of second connectors. Moreover, each of the connector receivers can have a first receiver depth that is different from a second receiver depth of each of the second connector receivers. For example, the first receiver depth can be greater than the second receiver depth. Further, the receiver assembly can include approximately 40 first connector receivers and approximately 38 second connector receivers.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
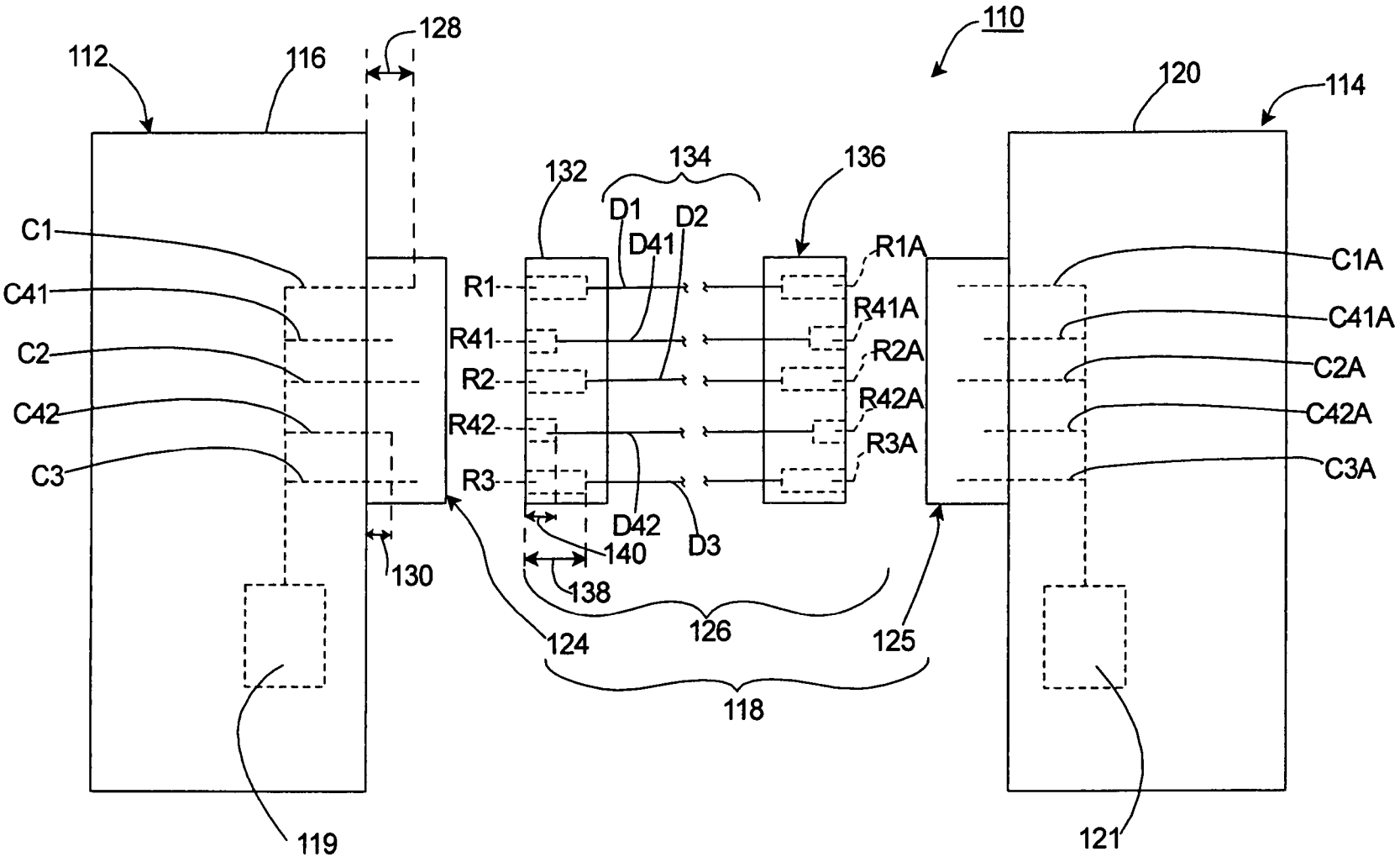
FIG. 1A is a simplified side view of a computer subsystem array including a connector assembly having features of the present invention.

FIG. 1A illustrates a simplified computer subsystem array 110 according to the present invention that includes a first computer subsystem 112, a second computer subsystem 114 and a connector assembly 118 that electrically connects the computer subsystems 112, 114. The first computer subsystem 112 includes a first subsystem housing 116 and a first circuit board 119 (illustrated in phantom). The second computer subsystem 114 includes a second subsystem housing 120 and a second circuit board 121 (illustrated in phantom).

The computer subsystem array 110 can be any two or more computer subsystems 112, 114 that electrically communicate to transfer information between the computer subsystems 112, 114. For example, the computer subsystem array 110 can include a hard disk drive that is coupled to a host such as a hard disk drive port. Alternatively, the computer subsystem array 110 can include a tape drive coupled to a tape drive port. Still alternately, the computer subsystem array 110 can include a CD or DVD player that is coupled to a CD or DVD port, respectively. In general, the present invention can effectively be incorporated into any computer subsystem array 110 that utilizes advanced technology attachment (ATA) or advanced technology attachment packetized interface (ATAPI) cables and connectors. It should be recognized that the foregoing examples are non-exclusive and should in no way be construed to limit the scope or application of the present invention.

The connector assembly 118 facilitates electrical communication between the first computer subsystem 112 and the second computer subsystem 114. The design of the connector assembly 118 can vary depending upon the design requirements of the first computer subsystem 112 and the computer subsystem array 110. In one embodiment, the connector assembly 118 includes a first receptacle 124, a second receptacle 125 and a receiver assembly 126. In FIG. 1A, the first receptacle 124 is electrically connected to the first circuit board 119, the second receptacle 125 is electrically connected to the second circuit board 121, and the receiver assembly 126 is adapted to receive at least a portion of the first receptacle 124 and the second receptacle 125.

In FIG. 1A, the first receptacle 124 is secured to the first subsystem housing 116, and the first receptacle 124 can be integrally formed with the first subsystem housing 116. Alternatively, the first receptacle 124 and the first subsystem housing 116 can be formed as separate structures that can be secured together.

The first receptacle 124 includes one or more male connectors. In the embodiment illustrated in FIG. 1A, the first receptacle 124 includes five male connectors that include three first connectors C1-3, and two second connectors C41-42. Although only five connectors C1-3, C41-42 are shown to simplify the illustration, the first receptacle 124 may in practice include any suitable number of connectors required for data transmission. For example, the first receptacle 124 can include 78 connectors. In the embodiment illustrated in FIG. 1A, the first connectors C1-3 have a first connector length 128 that is greater than a second connector length 130 of the second connectors C41-42, as described in greater detail below. In an alternative embodiment (not shown), the first connector length 128 and the second connector length 130 can be substantially similar. The connectors C1-78 can be formed from electrically conductive materials such as various metals or other well known conductive materials.

Similarly, in the embodiment illustrated in FIG. 1A, the second receptacle 125 is secured to the second subsystem housing 120. The second receptacle 125 can be integrally formed with the second subsystem housing 120. Alternatively, the second receptacle 125 and the second subsystem housing 120 can be formed as separate structures that are secured together.

The second receptacle 125 includes one or more male connectors. In FIG. 1A, the second receptacle 125 is substantially similar to the first receptacle 124. For example, the second receptacle 125 can include the same connector lengths and the same number of first connectors C1A-3A and second connectors C41A-42A as the first receptacle 124. Alternatively, for example, the second receptacle 125 can include first connectors C1A-3A having a different first connector length than the first connector length 128 of the first connectors C1-3 of the first receptacle 124. Still alternatively, the second receptacle 125 can exclude the second connectors C41A-42A, or can have a number of first connectors C1A-3A and/or second connectors C41A-42A that differ from the number of first connectors C1-3 and/or second connectors C41-42 of the first receptacle 124.

The receiver assembly 126 illustrated in FIG. 1A includes a first receiver end 132, a conductor array 134 such as a ribbon cable, and a second receiver end 136. Alternatively, for example, the receiver assembly 126 can include only one receiver end and the other end of the conductor array 134 can be hard-wired to the respective circuit board 119, 121. For instance, the receiver assembly 126 can include the first receiver end 132, which is secured to one end of the conductor array 134 and can engage with the first receptacle 124. The other end of the conductor array 134 can be hard-wired to the circuit board 121 of the second computer subsystem 114.

In FIG. 1A, the first receiver end 132 includes five female connector receivers, including three first connector receivers R1-3 and two second connector receivers R41-42. Although only five connector receivers R1-3, R41-42 are illustrated to simplify FIG. 1A, the first receiver end 132 can include any suitable number of connector receivers. Each first connector receiver R1-3 is adapted to receive one of the first connectors C1-3 of the first receptacle 124. Each second connector receiver R41-42 is adapted to receive one of the second connectors C41-42 of the first receptacle 124. The first connector receivers R1-3 can have a first receiver depth 138 that is greater than a second receiver depth 140 of the second connector receivers R41-42. With this design, the connector receivers R1-3, R41-42 can better accommodate reception of disparate connector lengths 128, 130 of the first and second connectors C1-3, C41-42. In an alternate embodiment (not shown), the first receiver depth 138 and the second receiver depth 140 can be substantially similar.

The conductor array 134 illustrated in FIG. 1A includes five insulated conductors D1-3, D41-42 that can carry data, control signals and the like between the first receiver end 132 and the second receiver end 136. Alternatively, one or more of the conductors D1-3, D41-42 can be ground conductors that span between the receiver ends 132, 136. Utilizing one or more ground conductors interspersed between signal-bearing conductors can reduce inductive cross-talk between adjacent signal-bearing conductors, thereby permitting data communication to occur at a relatively high rate along the conductor array 134. Further, the signal to noise ratio of the data transmitted along the conductor array 134 is increased. For example, in FIG. 1A, conductors D41, D42 can be ground conductors that are interspersed between conductors D1-3. The conductor array 134 can be formed as a ribbon cable that includes a sheath or substrate for enclosing and maintaining a suitable spacing between the conductors D1-3, D41-42. Alternately, the conductor array 134 can be comprised of individual conductors that are secured by other suitable means. The length of the conductor array 134 can be varied to suit the spacing requirements of the subsystems 112, 114.

The second receiver end 136 likewise includes three first connector receivers R1A-3A and two second connector receivers R41A-42A that mate with connectors from the second receptacle 125 of the second computer subsystem 114. The design of the second receiver end 136 can vary depending upon the requirements of the second computer subsystem 114. As illustrated in FIG. 1A, the second receiver end 136 can be substantially similar to the first receiver end 132. On the other hand, the second receiver end 136 can include greater or fewer second connector receivers R41A-42A than the first receiver end 132. Moreover, the second receiver end 136 can include second connector receivers R41A-42A having second receiver depths 140 that are different than the first receiver depths of the first connector receivers R1A-3A of the second receiver end 136.

When the connector receivers R1-3, R41-42, R1A-3A, R41A-42A are coupled to their respective connectors C1-3, C41-42, C1A-3A, C41A-42A, the first computer subsystem 112 is in electrical communication via the connector assembly 118 with the second computer subsystem 114 to permit data transfer to take place therebetween. Importantly, although the description provided herein focuses primarily on various embodiments of the first receptacle 124 and the first receiver end 132 of the receiver assembly 126, it should be recognized that the function and structure between the second receptacle 125 and the second receiver end 136 of the receiver assembly 126 can be substantially similar, but is no less significant.

Figure 1B:
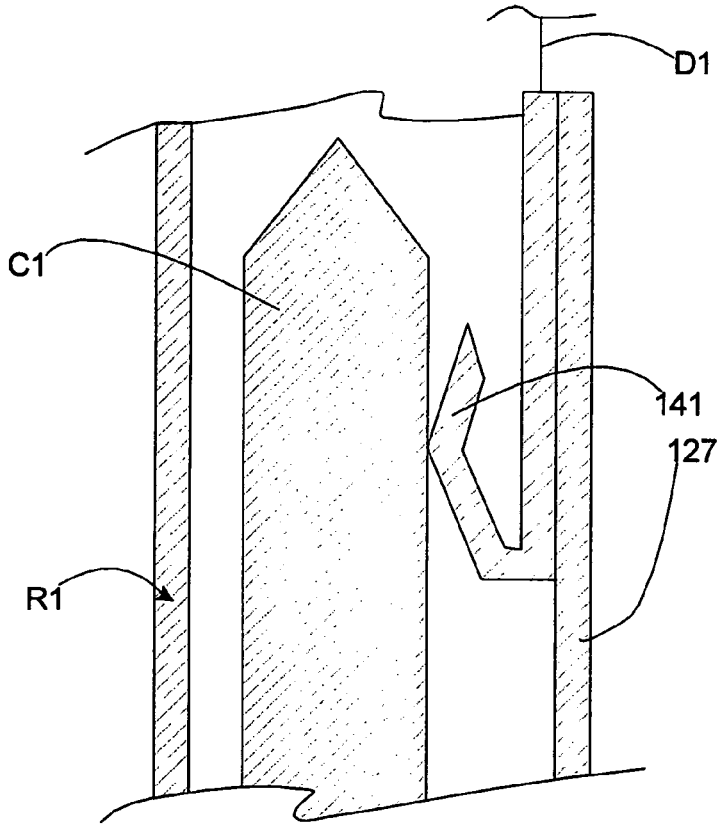
FIG. 1B is a cross-sectional view of a connector engaged with a connector receiver.

FIG. 1B illustrates in a cross-sectional view one example of the manner in which one of the connector receivers R1 engages one of the connectors C1 to make an electrical connection therewith. In this example, the connector receiver R1 includes a receiver housing 127 and a contact engaging structure 141. In the engaged position, the connector C1 contacts the contact engaging structure 141 of the connector receiver R1. In this embodiment, the contact engaging structure 141 is electrically coupled to conductor D1, thereby forming an electrical pathway between the connector C1 and the conductor array 134 (not shown in FIG. 1B). Although only one contact engaging structure 141 is illustrated in FIG. 1B, the connector receiver R1 can include greater than one contact engaging structure 141. Alternatively, electrical contact between the connector C1 and the conductor D1 can be accomplished in other ways known to those skilled in the art.

Figure 2A:
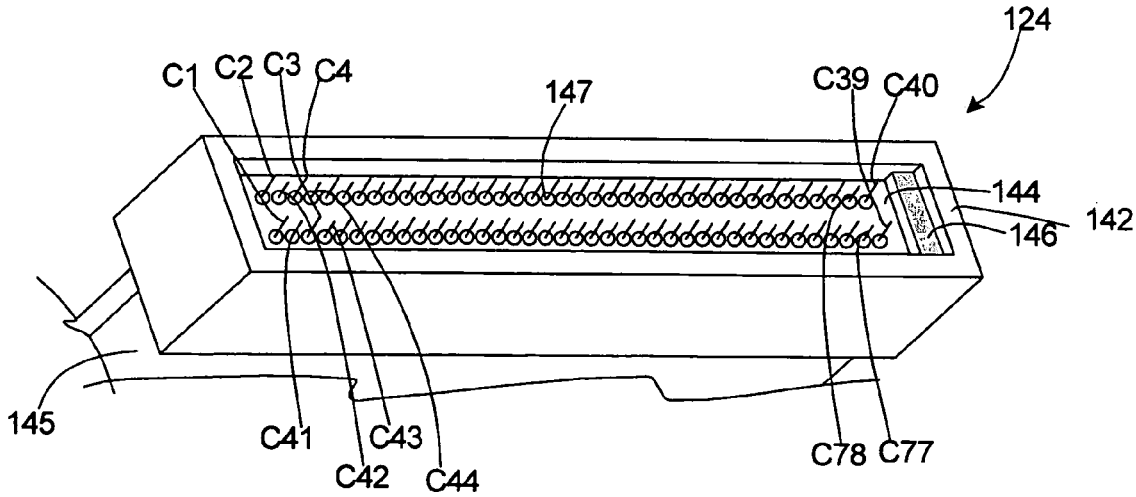
FIG. 2A is a perspective view of a connector assembly having features of the present invention.

FIG. 2A illustrates a perspective view of one embodiment of the first receptacle 124. The first receptacle 124 includes a receptacle housing 142, 40 first connectors C1-40 (only C1-4 and C39-40 are labeled for clarity), 38 second connectors C41-78 (only C41-44 and C77-78 are labeled for clarity), a receptacle base 144, a receptacle flex circuit 145, and one or more cable header stops 146. Each of the connectors C1-78 includes a connector fitting 147 that secures the connector C1-78 to the receptacle base 144. The connector fittings 147 can be an epoxy material or any other suitable material that can secure the connectors C1-78 to the receptacle base 144. The connectors C1-78 can also be molded into a plastic shroud (not shown).

Figure 2B:
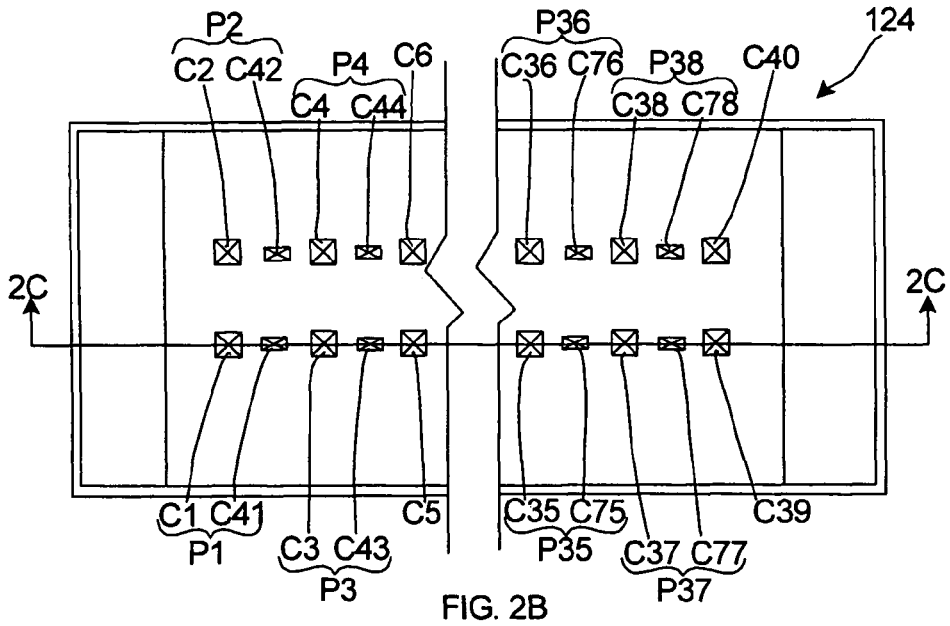
FIG. 2B is an end view of the connector assembly illustrated in FIG. 2A.

FIG. 2B illustrates an end view of another embodiment of the first receptacle 124. In this embodiment, the first connectors C1-40 are represented by squares, and the second connectors C41-78 are represented by rectangles. Inadvertent misalignment between the connectors C1-78 and the connector receivers (not shown in FIG. 2B) is inhibited by utilizing first connectors C1-40 and second connectors C41-78 with different cross-sectional shapes that can mate with different cross-sectional shapes of the connector receivers. However, the actual cross-sectional geometry of the connectors C1-78 can vary. For example, the cross-sectional shape of the connectors C1-78 can be circular, elliptical, triangular or any other suitable geometric configuration. In the embodiment illustrated in FIG. 2B, the cross-sectional geometry of the first connectors C1-40 and the second connectors C41-78 is different. Alternatively, the first connectors C1-40 and the second connectors C41-78 can have the same cross-sectional geometric shape. Additional known methods for inhibiting misalignment of the connectors and the connector receivers in the connector assembly can also be utilized with the present invention.

Further, in the embodiment illustrated in FIG. 2B, the first connectors C1-40 are aligned in two substantially collinear, parallel rows. The second connectors C41-78 are likewise positioned in two substantially collinear, parallel rows so that the second connectors C41-78 are interspersed with the first connectors C1-40. Stated another way, each of the second connectors C41-78 is positioned substantially directly between a corresponding pair of the first connectors C1-40. For example, second connector C41 is positioned substantially directly between a first connector pair C1, C3. Alternatively, the second connectors C41-78 need not be positioned between a pair of the first connectors C1-40. Still alternately, the connectors C1-78 can be aligned in greater or fewer than two rows, or can be positioned in a random or a semi-random configuration.

In FIG. 2B, the first connectors C1-40 are positioned having a conventional legacy connector specification utilizing the standard 40-connector alignment. In this embodiment, the legacy connectors C1-40 are positioned at approximately 50 mils on center. Each of the second connectors C41-78 is positioned approximately midway between each corresponding pair of first connectors C1-40. Thus, each second connector C41-78 is positioned approximately 25 mils on center from each first connector C1-40 in the corresponding pair of first connectors C1-40. However, the spacing of the first connectors C1-40 and the second connectors C41-78 can vary.

One or more of the first connectors C1-40 can be a data pin or a control signal pin, which transmits data and/or other electrical signals to and from the receiver assembly (not shown in FIG. 2B). The number of first connectors C1-40 that are data pins or control signal pins can be varied. In one embodiment, of the 40 first connectors C1-40, sixteen are data pins. Additionally, certain first connectors C1-40 can be ground pins. For example, first connectors C2, C19, C22, C24, C26, C30 and C40 can be designated as ground pins. Alternately, any of the first connectors C1-40 can be designated as ground pins. The first connectors C1-40 that serve as ground pins are grounded in ways known to those skilled in the art. For instance, the ground pins can be grounded to the first subsystem housing (not shown in FIG. 2B), or to any other suitable structure.

The second connectors C41-78 of the first receptacle 124 can similarly be ground pins, data pins, or control signal pins. In one embodiment, all of the second connectors C41-78 are ground pins. By interspersing second connectors C41-78 which serve as ground pins between each corresponding pair of first connectors C1-40, a more proximate path to ground for each data pin or control signal pin is provided. The more proximate path to ground can allow for a higher speed of data transmission. Further, because ground pins are positioned between the data and/or control signal pins, inductive cross-talk is reduced. A reduction in inductive cross-talk can result in an increased accuracy and/or rate of data transfer between computer subsystems. This type of receptacle 124 having interspersed ground pins between the first connectors C1-40 is referred to as a single-ended receptacle 124. In a single ended receptacle 124, the voltage of each data pin is measured against ground.

In another embodiment, certain of the second connectors C41-78 are data pins. In this embodiment, each of the first connectors C1-40 that are data pins is positioned immediately adjacent a corresponding second connector C41-78 that is also a data pin, thereby forming a plurality of differential pairs P1-38 (only differential pairs P1-4, P35-38 are shown) that include a first connector and a second connector. For example, in FIG. 2B, first connector C3 and second connector C43 form a differential pair P3. This type of receptacle is known as a low voltage differential (LVD) receptacle. The concept of low voltage differential signaling is well known in the art. Essentially, in a low voltage differential receptacle, the voltage of each first connector data pin C1-40 is measured against the voltage of each corresponding second connector data pin C41-78, rather than to ground. The differential pairs P1-38 of connectors are also referred to herein as low voltage differential pairs.

Figure 2C:
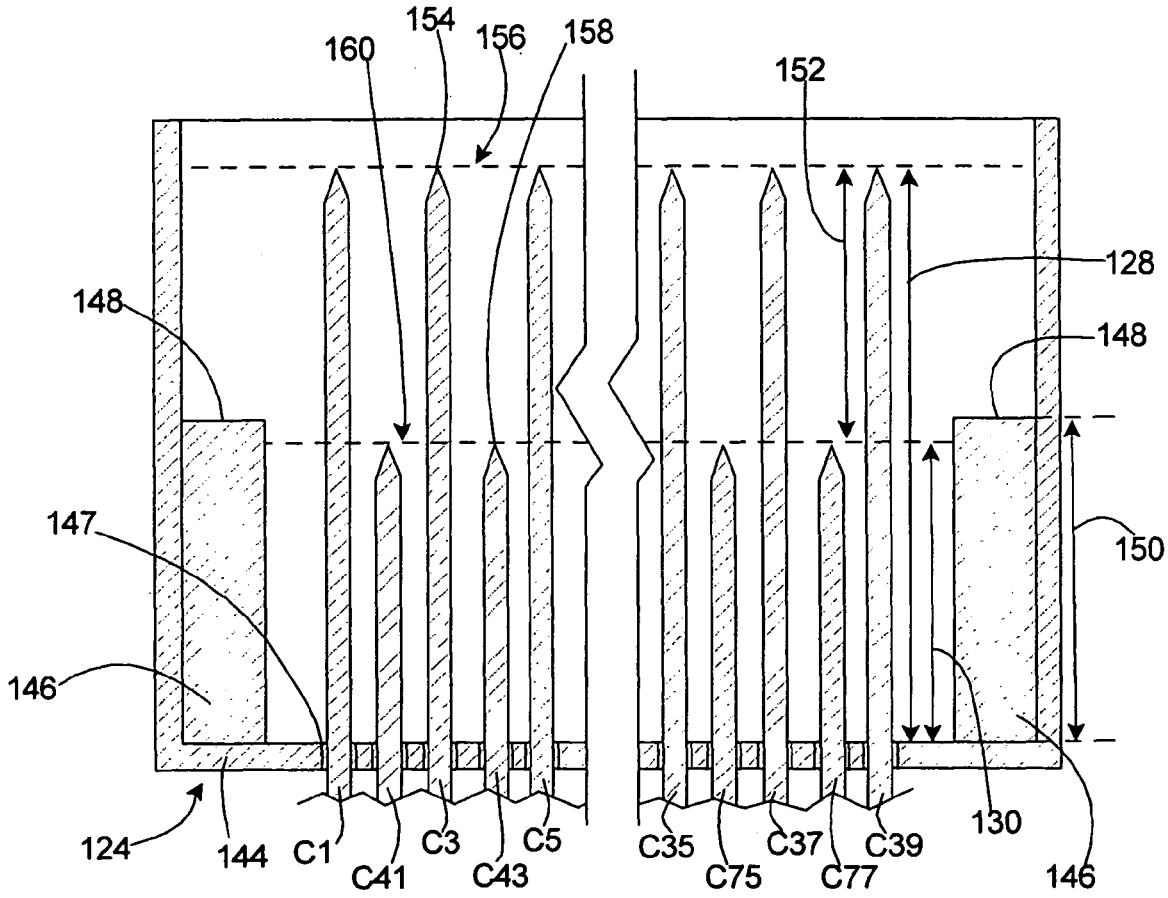
FIG. 2C is a cross-sectional view taken on line 2C-2C in FIG. 2B.

FIG. 2C is a cross-sectional view of the first receptacle 124 illustrated in FIG. 2B. FIG. 2C illustrates that the first receptacle 124 can also include the receptacle base 144 and one or more of the cable header stops 146. The receptacle base 144 secures the first and second connectors C1-78 to the first subsystem housing 116 (not shown in FIG. 2C). The receptacle base 144 secures each of the connector fittings 147, and also maintains an appropriate spacing between the connectors C1-78.

The cable header stops 146 inhibit potential damage to the second connectors C41-78 when the first receptacle 124 is used with a receiver assembly having a first receiver end (not shown in FIG. 2C) that includes a legacy 40-connector receiver configuration. Each cable header stop 146 includes a stop surface 148 that contacts the first receiver end to limit the depth of engagement between the connector receivers and the first connectors C1-40, thereby promoting backward compatibility, as described in greater detail below. The shape of the cable header stop 146 can vary, provided the cable header stop 146 is accordingly positioned to limit the extent of engagement between the first receptacle 124 and the receiver assembly. For example, the cable header stop 146 can have a height 150 that is greater than the second connector length 130. Alternately, the cable header stop 146 can cantilever from other portions of the first receptacle 124. The cable header stop 146 can be formed from any suitably rigid materials that will not significantly interfere with electrical transmission between the first receptacle 124 and the receiver assembly.

The first receptacle 124 includes the first connectors C1-40 with a first connector length 128 that is greater than the second connector length 130 of the second connectors C41-78. In this embodiment, the first connector length 128 is approximately equal to the sum of a standard length 152 of a legacy connector and the second connector length 130. FIG. 2C illustrates that each of the first connectors C1-40 includes a first connector end 154. The first connector ends 154 generally lie in a first connector end plane (shown by dotted line 156). Each second connector C41-78 includes a second connector end 158. The second connector ends 158 generally lie in a second connector end plane (shown by dotted line 160). Further, one or more of the stop surfaces 148 of the cable header stops 146 are positioned substantially between the first connector end plane 156 and the second connector end plane 160.

Alternatively, for example, the first connector length 128 can be approximately 10 percent, 25 percent, 50 percent, 75 percent, 100 percent, 150 percent or 200 percent greater than the second connector length 130.

Figure 3A:
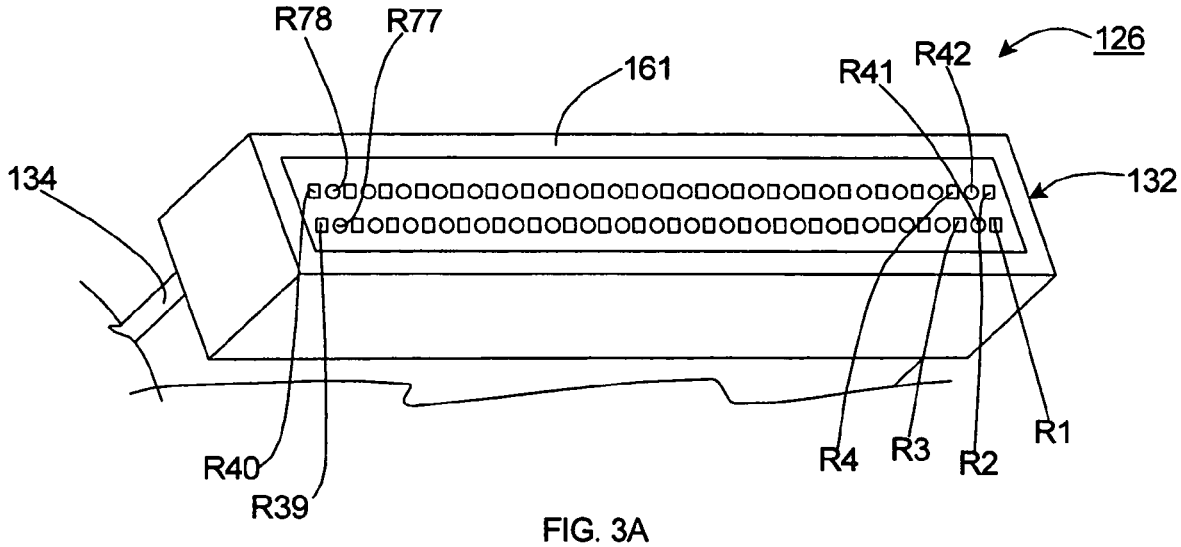
FIG. 3A is a perspective view of a receiver assembly having features of the present invention.

FIG. 3A illustrates a perspective view of one embodiment of a portion of the receiver assembly 126 including the first receiver end 132 and the conductor array 134. The first receiver end 132 includes a receiver housing 161, 40 first connector receivers R1-40 (represented by squares, only R1-4 and R39-40 are labeled for clarity), and 38 second connector receivers R41-78 (represented by circles, only R41-44 and R77-78 are labeled for clarity).

Figure 3B:
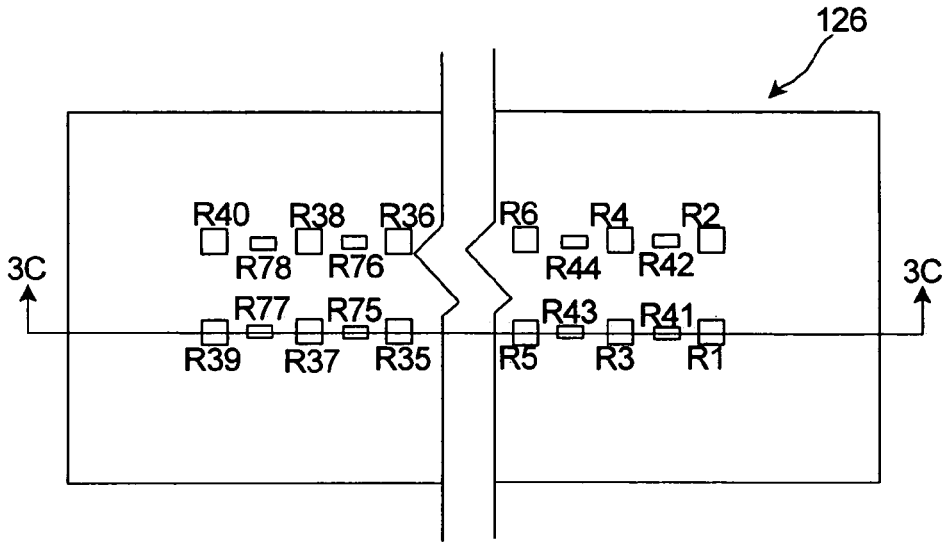
FIG. 3B is an end view of a portion of the receiver assembly illustrated in FIG. 3A.

FIG. 3B illustrates an end view of one embodiment of the first receiver end 132 of the receiver assembly 126 as viewed from a mating side that engages with the first receptacle 124 (shown in FIG. 2A). The connector receivers R1-78 are aligned, sized and shaped to receive the connectors C1-78 (shown in FIG. 2A), respectively. As provided above, misalignment between the connectors C1-78 and the connector receivers R1-78 is inhibited by using first connector receivers R1-40 and second connector receivers R41-78 with different cross-sectional shapes that can receive corresponding connectors C1-40, C41-78. However, the actual cross-sectional geometry of the connector receivers R1-78 can vary. For example, the cross-sectional shape of the connector receivers R1-78 can be circular, elliptical, triangular or any other suitable geometric configuration. In the embodiment illustrated in FIG. 3B, the cross-sectional geometry of the first connector receivers R1-40 and the second connector receivers R41-78 is different. Alternatively, the first connector receivers R1-40 and the second connector receivers R41-78 can have the same cross-sectional geometry.

Further, in the embodiment illustrated in FIG. 3B, the first connector receivers R1-40 are aligned in two substantially collinear, parallel rows. The second connector receivers R41-78 are likewise positioned in two substantially collinear, parallel rows so that the second connector receivers R41-78 are interspersed with the first connector receivers R1-40. Stated another way, each of the second connector receivers R41-78 is positioned substantially directly between a corresponding pair of the first connector receivers R1-40. For example, second connector receiver R41 is positioned substantially directly between a first connector receiver pair R1, R3. Alternatively, the second connector receivers R41-78 need not be positioned directly between a pair of the first connector receivers R1-40. Still alternately, the connector receivers R1-78 can be aligned in greater or fewer than two rows, or can be positioned in a random or semi-random configuration.

In FIG. 3B, the first connector receivers R1-40 are positioned having a conventional legacy connector receiver specification utilizing the standard 40-receiver alignment. The legacy connector receiver specification includes positioning the first connector receivers R1-40 at approximately 50 mils on center. Each of the second connector receivers R41-78 is positioned approximately midway between each corresponding pair of first connector receivers R1-40. Thus, each second connector receiver R41-78 is positioned approximately 25 mils on center from each first connector receiver R1-40 in the corresponding pair of first connector receivers R1-40. However, the spacing of the first connector receivers R1-40 and the second connector receivers R41-78 can vary.

Figure 3C:
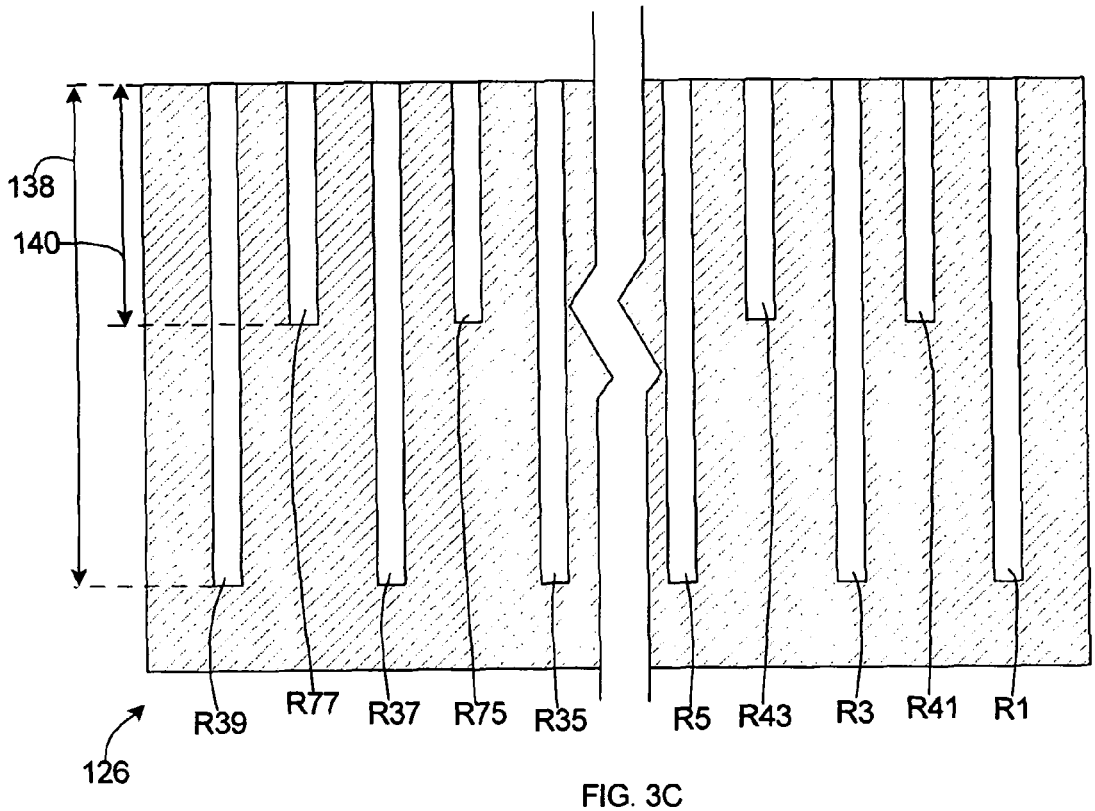
FIG. 3C is a cross-sectional view taken at line 3C-3C in FIG. 3B.

FIG. 3C is a cross-sectional view of the receiver assembly 126 in FIG. 3B. The contact engaging structures 141 (illustrated in FIG. 1B) have been omitted from FIG. 3C for clarity. In this embodiment, each first connector receiver R1-40 has a first receiver depth 138 that can receive substantially the entire length of each first connector C1-40. Each second connector receiver R41-78 has a second receiver depth 140 that can receive substantially the entire length of each second connector C41-78.

As examples, the first receiver depth 138 can be approximately 10 percent, 25 percent, 50 percent, 75 percent, 100 percent, 150 percent or 200 percent greater than the second receiver depth 140.

Figure 4A:
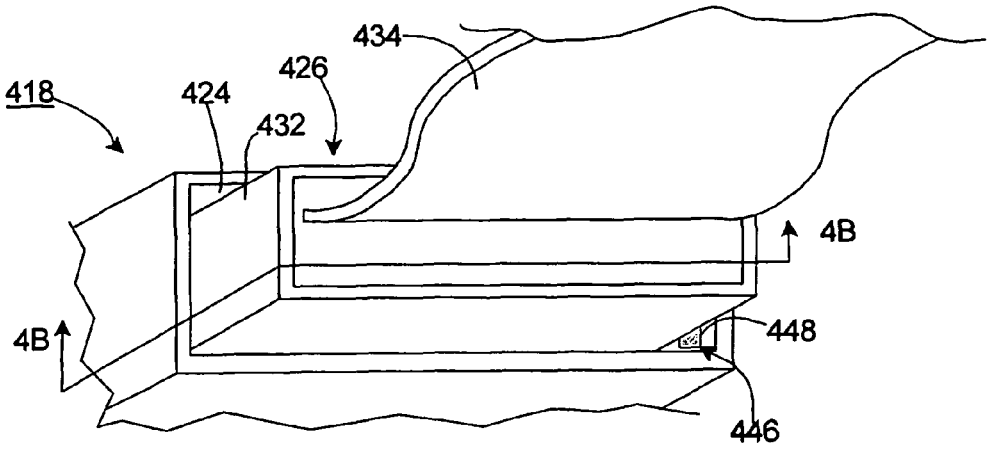
FIG. 4A is a bottom perspective view of a portion of the connector assembly including a receptacle engaged with a receiver assembly.

FIG. 4A illustrates a perspective view of a connector assembly 418 including a first receptacle 424 and a receiver assembly 426 in the engaged position. The first receptacle 424 includes one or more cable header stops 446 that each has a stop surface 448. The receiver assembly 426 includes a first receiver end 432 and a conductor array 434.

Figure 4B:
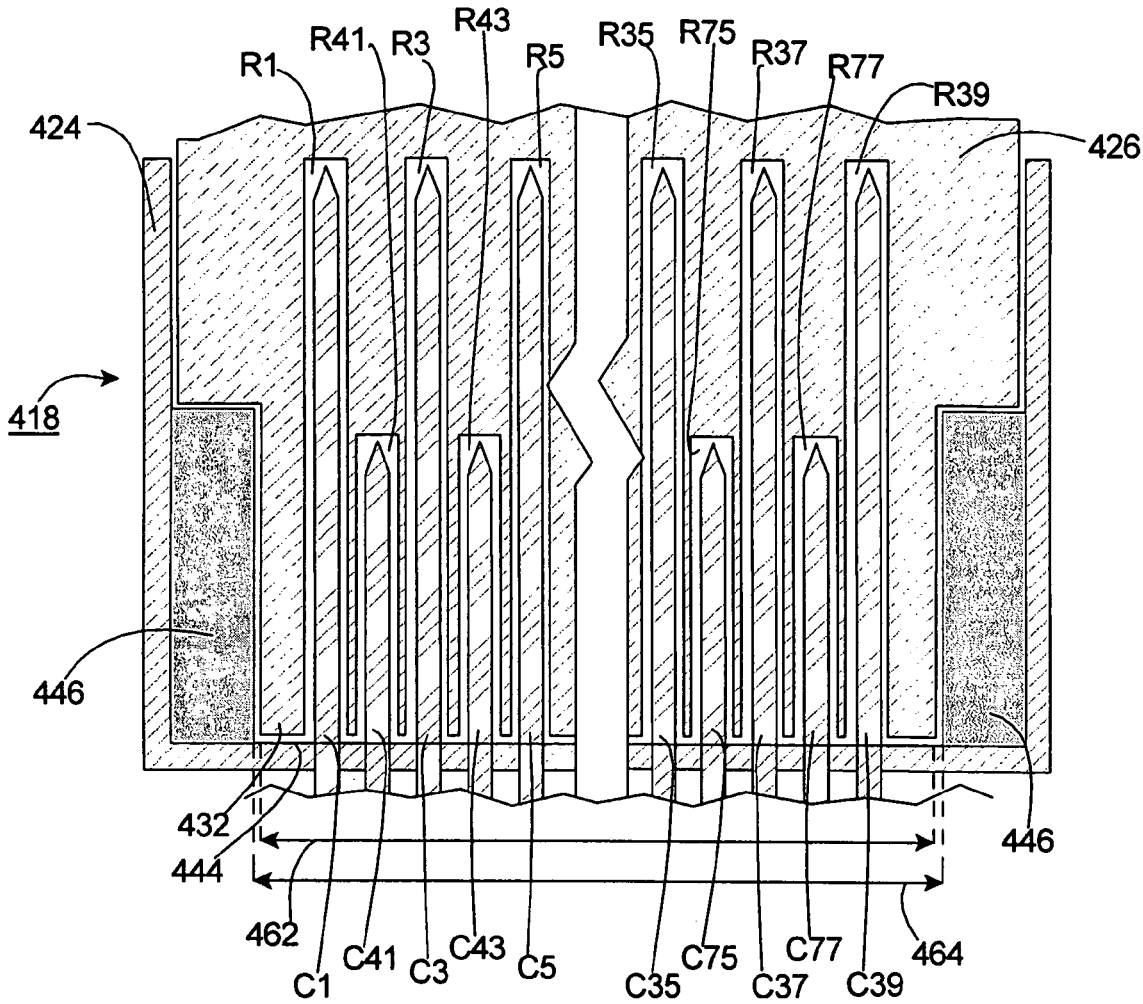
FIG. 4B is an enlarged partial cross-sectional view taken on line 4B-4B in FIG. 4A.

FIG. 4B is a partial cross-sectional view of the connector assembly 418 in FIG. 4A. In this embodiment, the first receptacle 424 includes 78 connectors, of which 40 are first connectors C1-40, and 38 are second connectors C41-78. The receiver assembly 426 includes 78 connector receivers R1-78, of which 40 are first connector receivers R1-40, and 38 are second connector receivers R41-78. The receiver assembly 426 includes the first receiver end 432. The contact engaging structures 141 have been omitted from FIG. 4B for clarity.

In this embodiment, the first receiver end 432 has a first end width 462 that is less than a distance 464 between the cable header stops 446, which allows the first receiver end 432 to bottom out against a receptacle base 444 of the first receptacle 424. With this design, the cable header stops 446 permit full engagement between the first receptacle 424 and the first and second connector receivers R1-78. In an alternate embodiment (not shown), the first receiver end 432 can include a notch on each side of the first receiver end 432 which allow the first receiver end 432 to substantially bottom out against the receptacle base 444 of the first receptacle 424, with the notches abutting the cable header stops 446.

Figure 5A:
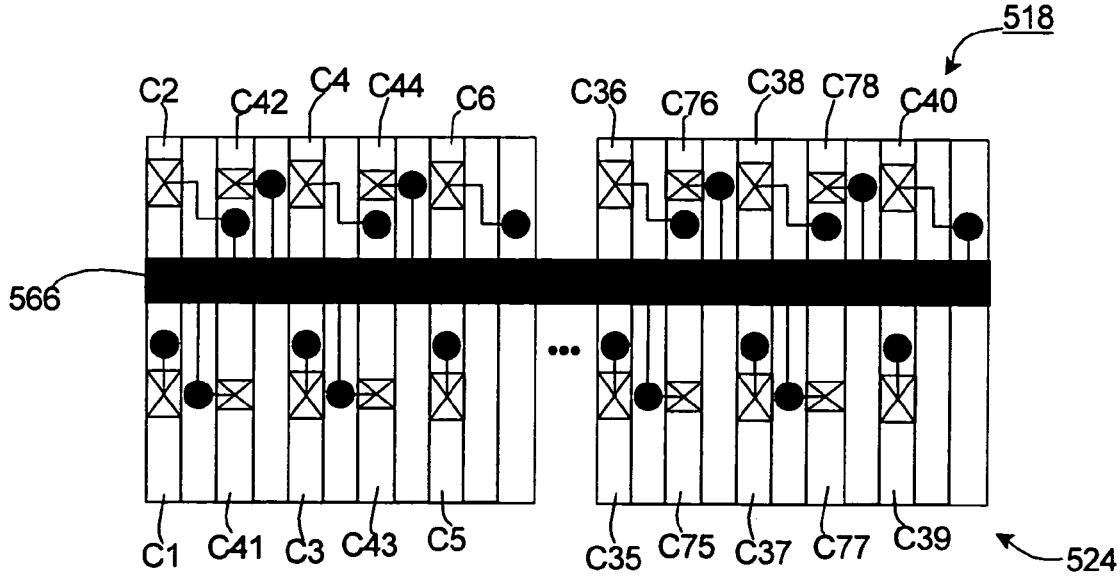
FIG. 5A is a schematic diagram of one embodiment of a connector assembly.

FIG. 5A schematically illustrates an embodiment of a single ended connector assembly 518. In this embodiment, the first connectors C1-40 and 38 second connectors C41-78 are engaged with first connector receivers R1-40 (not shown in FIG. 5A) and second connector receivers R41-78 (not shown in FIG. 5A), respectively. The 40 first connectors C1-40 can include data pins, control signal pins and/or ground pins. The ground pins can be positioned in any suitable location along the first receptacle 524, such as in locations C2, C19, C22, C24, C26, C30 and C40 (only C2 and C40 are illustrated in FIG. 5A), as one example.

Alternately, the first connectors C1-40 can include ground pins at different positions, or can completely exclude ground pins. The 38 second connectors C41-78 in this embodiment are all ground pins. The ground pins can be grounded within the first computer subsystem in ways known to those skilled in the art. For example, the ground pins can be grounded to a portion of the first subsystem housing. In this embodiment, the receiver assembly includes a ground bar 566 that can be positioned within the first receiver end. As illustrated, various first connectors (only first connectors C2 and C40 are shown for clarity) can be coupled to the ground bar 566 upon engagement between the first receptacle and the receiver assembly. Further, each of the second connectors C41-78 are coupled to the ground bar 566 when the connector assembly 518 is in the engaged position.

Figure 5B:
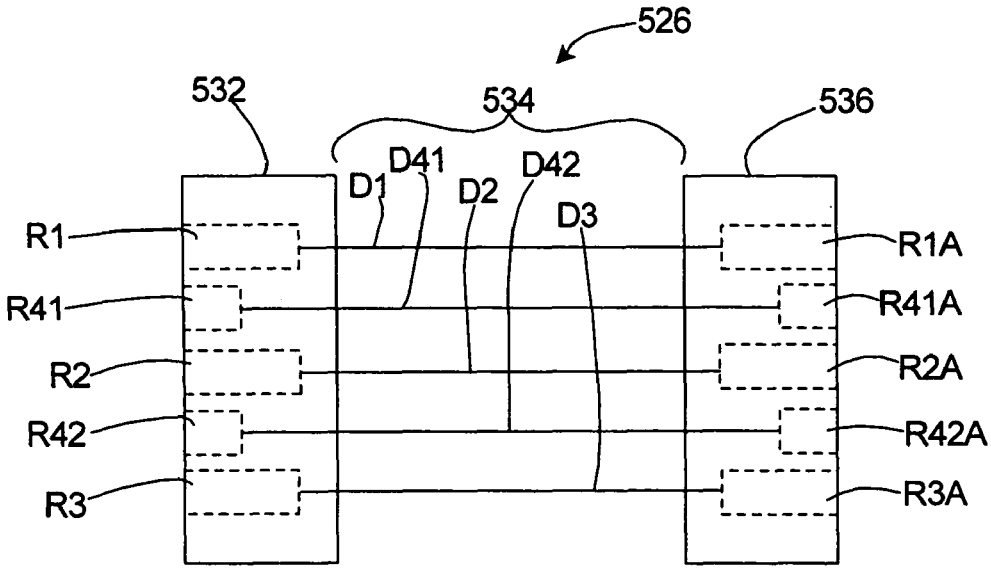
FIG. 5B is a simplified side view of a receiver assembly.

FIG. 5B is a simplified receiver assembly 526 having a first receiver end 532, a conductor array 534 and a second receiver end 536. The conductor array 534 of the receiver assembly 526 can include any number of conductors. Although the conductor array 534 in FIG. 5B includes only five conductors D1-3, D41-42 for convenience of discussion, it is recognized that an appropriate number of conductors for a conductor array 534 of the connector assembly 518 (illustrated in FIG. 5A) is approximately 78 conductors D1-78. The conductors D1-3, D41-42 span from the connector receivers R1-3, R41-42 of the first receiver end 532 to the connector receivers R1A-3A, R41A-42A of the second receiver end 536. Among these conductors are signal-bearing conductors D1-3 and ground conductors D41-42. In this embodiment, the signal bearing conductors D1-3 can be positioned with the ground conductors D41-42 so that no two signal-bearing conductors D1-3 are directly adjacent to one another, thereby reducing the likelihood of cross-talk between the signal-bearing conductors D1-3. The ground conductors D41-42 can be bussed together at the ground bar 566 (shown in FIG. 5A) in the first receiver end 532.

Alternatively, in embodiments that either utilize or do not utilize the ground bar 566, the ground conductors D41-42 can be coupled to the second connectors C41-42 (ground pins) directly via the second connector receivers R41-42. In the latter instance, the path to ground for each ground conductor D41-42 is reduced due to a more direct route between the ground conductors D41-42 and the second connectors C41-42. The second receiver end 536 can be similarly configured to the first receiver end 532, and can also include the ground bar 566 (illustrated in FIG. 5A).

Figure 6:
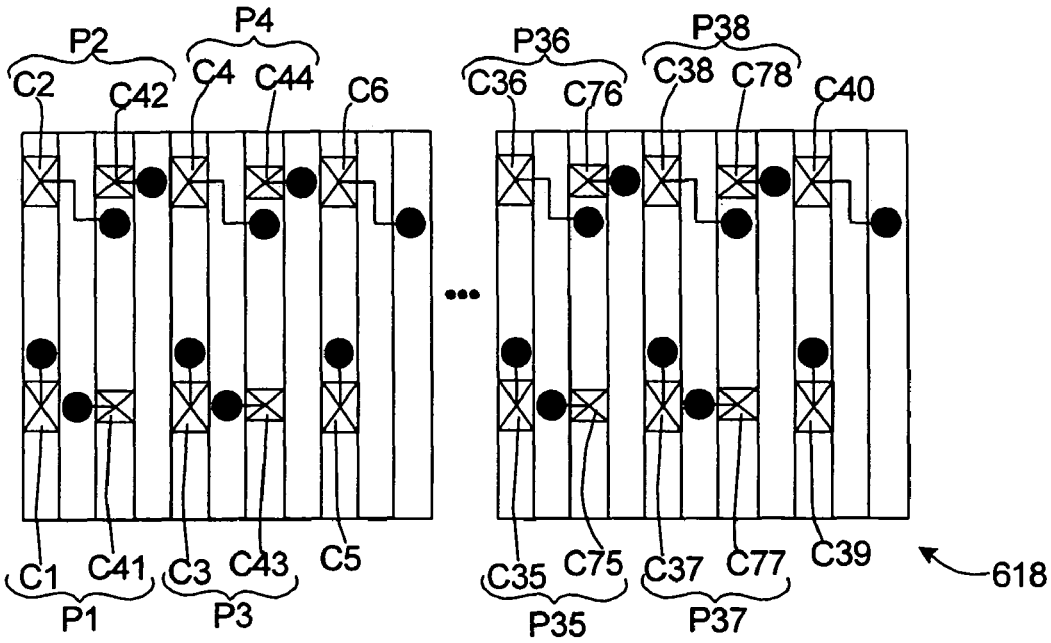
FIG. 6 is a schematic diagram of another embodiment of a connector assembly.

FIG. 6 schematically illustrates another embodiment of the connector assembly 618. In this embodiment, the connector assembly 618 utilizes low voltage differential (LVD) signaling. The ground bar is unnecessary. Instead, a plurality first connectors C1-38 are paired with a plurality of corresponding second connectors C41-78, which are in close proximity to the first connectors. For example, a differential pair P1 includes first connector C1 and second connector C41. Other differential pairs P2, P3, P4, P35, P36, P37 and P38 are also illustrated in FIG. 6. Although the differential pairs P1-4, P35-38 illustrated in FIG. 6 include connectors that are immediately adjacent to one another, this configuration is not required.

Rather than utilizing the second connectors C41-78 as ground pins, certain second connectors C41-78 are used as data pins. In one embodiment, wherever a first connector C1-40 is used as a data pin, a corresponding second connector C41-78 forms a differential pair with the first connector, setting up low voltage differential signaling. Stated another way, rather than measuring the voltage of the first connector pin, e.g. C3, against ground, the voltage of first connector pin C3 is measured against the voltage of second connector pin C43. The concept of low voltage differential to increase data transfer rates is well known. However, due to the limitation on the number of connectors in the legacy 40-connector ATA specification, low voltage differential signaling has heretofore been incompatible with the standard legacy connector assembly specification.

In another embodiment, 16 of the 40 first connectors C1-40 are designated as data pins. Consequently, 16 of the 38 second connectors C41-78 are likewise designated as data pins, thereby forming 16 differential pairs with the 16 first connector data pins. As an example, first connectors C2, C19, C22, C24, C26, C30 and C40 can serve as ground pins, and the remaining 17 first connectors can be control signal pins. The remaining 22 second connectors that are not included in the differential pairs with the 16 first connectors can be ground pins or control signal pins.

The number of first connectors C1-40 and second connectors C41-78 that can be ground pins, data pins or control signal pins can be varied. The embodiments provided herein are for convenience of discussion only, and should not be construed to limit the scope of the present invention in any way.

Figure 7:
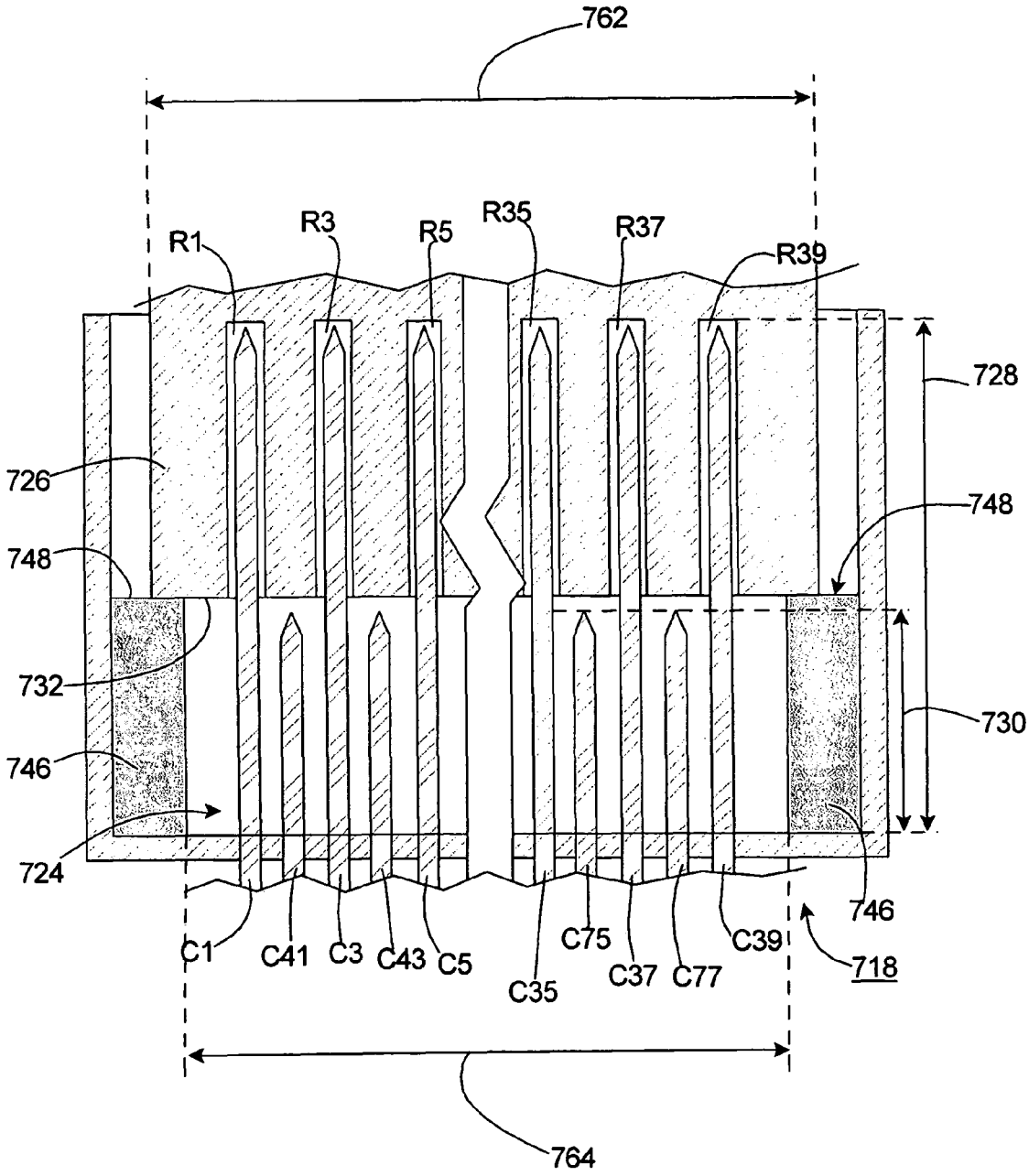
FIG. 7 is a cross-sectional view of a portion of a connector assembly including a receptacle having features of the present invention engaged with a prior art receiver assembly.

FIG. 7 is a cross-sectional view of a portion of a connector assembly 718, which includes a first receptacle 724 engaged with a legacy receiver assembly 726. FIG. 7 illustrates the backward compatibility of the first receptacle 724 with a receiver assembly 726 that utilizes the legacy 40-connector receivers R1-40. The receiver assembly 726 may or may not include a ground bar (not shown in FIG. 7). The contact engaging structures 141 (illustrated in FIG. 1B) have been omitted from the receiver assembly 726 for clarity. The first receptacle 724 includes a plurality of first connectors C1-40 and a plurality of second connectors C41-78.

In this embodiment, the first receptacle 724 includes 40 first connectors C1-40 each having a first connector length 728 that is greater than a second connector length 730 of each of the 38 second connectors C41-78. Further, the first receptacle 724 includes two cable header stops 746, each having a stop surface 748. The first receptacle 724 has a distance 764 between the cable header stops 746 that is less than a first end width 762 of the legacy receiver assembly 726. With this design, during engagement between the receiver assembly 726 and the first receptacle 724, the first receiver end 732 contacts the stop surfaces 748 of the cable header stops 746. As a result, the cable header stops 746 limit the extent of engagement of the receiver assembly 726 with the first receptacle 724. In this manner, only the first connectors C1-40 engage the receiver assembly 726. The second connectors C41-78 do not engage the receiver assembly 726. Further, the likelihood of damage to the second connectors C41-78 is reduced due to the presence of the cable header stops 746, which inhibit contact between the second connectors C41-78 and the first receiver end 732.

In the embodiment illustrated in FIG. 7, data transfer occurs using only the 40 engaged first connectors C1-40 and the receiver assembly 726. The first computer subsystem can recognize that the second connectors C41-78 are not being utilized, and can adjust data transmission so that all necessary data is transmitted by the first receptacle 724 using only the first connectors C1-40. In other words, despite the lack of engagement between of the second connectors C41-78, the connector assembly 718 can still efficiently transmit data, although not at the increased rate such as in embodiments utilizing 78 connectors C1-78 and 78 connector receivers R1-78, as previously described.

Figure 8:
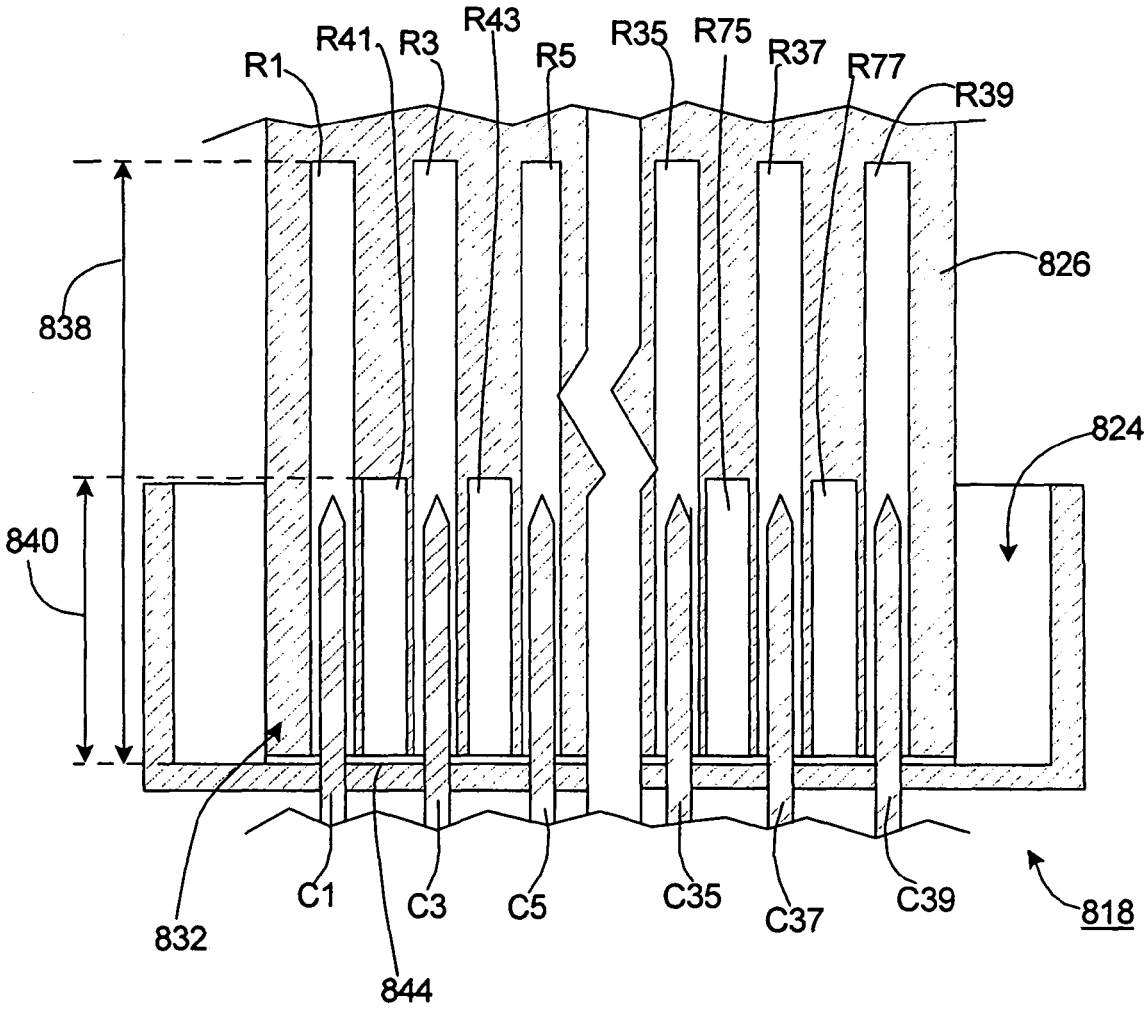
FIG. 8 is a cross-sectional view of a portion of a connector assembly including a prior art receptacle engaged with a receiver assembly having features of the present invention.

FIG. 8 is a cross-sectional view of a connector assembly 818 that includes a receiver assembly 826 having features of the present invention engaged with a legacy first receptacle 824. FIG. 8 illustrates the backward compatibility of the receiver assembly 826 with a 40-connector first receptacle 824. The receiver assembly 826 includes a plurality of first connector receivers R1-40, a plurality of second connector receivers R41-78, and can also include a ground bar (not shown in FIG. 8). Further, the contact engaging structures 141 (illustrated in FIG. 1B) have been omitted from FIG. 8 for clarity. In this embodiment, the first receiver end 832 includes 40 first connector receivers R1-40 each having a first receiver depth 838 that is greater than a second receiver depth 840 of each of the 38 second connector receivers R41-78.

In the embodiment illustrated in FIG. 8, the legacy first receptacle 824 includes 40 first connectors C1-40. The first receptacle 824 does not include any second connectors. Further, the first receptacle 824 does not include the cable header stops. The first connector receivers R1-40 of the first receiver end 832 are positioned to mate with and facilitate electrical communication with the first connectors C1-40. However, the second connector receivers R41-78 remain vacant due to the lack of second connectors. During full engagement, the first receiver end 832 can extend to contact the receptacle base 844 of the first receptacle 824.

In the embodiment illustrated in FIG. 8, data transfer occurs using only the 40 engaged first connectors C1-40 and the receiver assembly 826. The first computer subsystem does not include any second connectors, and thus all necessary data is transmitted by the connector assembly 818 using the first connectors C1-40 and the receiver assembly 826. Despite the lack of engagement between of the second connector receivers R41-78 and the first receptacle 824, the connector assembly 818 can still efficiently transmit data, although not at the increased rate such as in embodiments utilizing 78 connectors C1-78 and 78 connector receivers R1-78, as previously described herein.

While the particular connector assembly 118 and computer subsystem array 110 as herein shown and disclosed in detail are fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A receiver assembly for use in a connector assembly that facilitates electrical communication between a first computer subsystem and a second computer subsystem, the receiver assembly adapted to be coupled between the first computer subsystem and the second computer subsystem, the receiver assembly comprising a first row of substantially collinear, spaced-apart, first connector receivers;

a second row of substantially collinear, spaced-apart, first connector receivers, wherein each first connector receiver defines a first connector engaging location and each first connector receiver having a first receiver depth, and each of the first connector engaging locations being arranged substantially collinearly; and a plurality of spaced apart second connector receivers each having a second receiver depth that is different than the first receiver depth, wherein the second connector receivers are interspersed between and substantially collinear with the first connector receivers along at least one of the rows of first connector receivers so that each of the second connector receivers is positioned substantially between a corresponding pair of the first connector receivers, the second connector receivers each define a second connector engaging location, and the second connector engaging locations are positioned substantially collinear with the first connector engaging locations.

2. The receiver assembly of claim 1 wherein the second connector receivers are positioned in two second connector receiver rows, each second connector receiver row having 19 substantially collinear second connector receivers.

3. The receiver assembly of claim 1 wherein the first connectors are positioned in two first connector receiver rows each having 20 substantially collinear first connector receivers, and wherein each first connector receiver row is substantially collinear with a corresponding second connector receiver row.

4. The receiver assembly of claim 1 wherein each of the second connector receivers is positioned approximately equidistant from each first connector receiver in each of the corresponding pairs of first connector receivers.

5. The receiver assembly of claim 1 wherein the first connector receivers are positioned at approximately 50 mils on center, and the second connector receivers are each positioned approximately 25 mils from each of the first connector receivers in the corresponding pair of first connector receivers.

6. The receiver assembly of claim 1 further comprising a conductor array that electrically couples the first connector receivers and the second connector receivers to one of the first computer subsystem or the second computer subsystem.

7. The receiver assembly of claim 1 wherein the receiver assembly includes 40 first connector receivers and 38 second connector receivers.

8. The receiver assembly of claim 1, wherein the first receiver depth is greater than the second receiver depth.

9. A receptacle for use in a connector assembly that facilitates electrical communication between a first computer subsystem and a second computer subsystem which are connected via a receiver assembly, the receiver assembly including a plurality of connector receivers, the receptacle adapted to be electrically connected to the first computer subsystem and coupled with the second computer subsystem via the receiver assembly, the receptacle comprising a plurality of spaced-apart first connectors each having a first connector length, a plurality of spaced-apart second connectors each having a second connector length that is shorter than the first connector length; and a housing configured to prevent engagement between the second connectors and any of the connector receivers while allowing each of the first connectors to engage a corresponding connector receiver when the combined quantity of first and second connectors is greater than the quantity of connector receivers.

10. The receptacle of claim 9 wherein when the number of connectors equals the number of connector receivers, the housing is further configured to allow the first connectors to engage some of the connector receivers, and the second connectors to engage the remaining connector receivers.

11. The receptacle of claim 9 wherein the housing further comprises a cable header stop that inhibits contact between the second connectors and the receiver assembly.

12. The receptacle of claim 9 wherein the receptacle includes 40 first connectors.

13. The receptacle of claim 9 wherein the receptacle includes 40 first connectors and 38 second connectors.

14. The receptacle of claim 13 wherein the first connectors are positioned in two rows each having 20 substantially collinear first connectors, the second connectors are positioned in two rows each having 19 substantially collinear second connectors, and wherein each row of first connectors is substantially collinear with a corresponding row of second connectors.

15. The receptacle of claim 9 wherein the second connectors are interspersed between the first connectors so that each of the second connectors is positioned substantially directly between a corresponding pair of the first connectors.

16. The receptacle of claim 15 wherein each of the second connectors is positioned approximately equidistant from each first connector in each of the corresponding pairs of first connectors.

17. The receptacle of claim 15 wherein the first connectors are positioned at approximately 50 mils on center, and the second connectors are each positioned approximately 25 mils from each of the first connectors in the corresponding pair of first connectors.

18. The receptacle of claim 9 wherein the first connectors include a plurality of data pins and each of the second connectors is a ground pin.

19. The receptacle of claim 9 wherein the first connectors include a plurality of data pins and the second connectors include a plurality of data pins.

20. The receptacle of claim 19 wherein the first connectors are each first data pins and the second connectors are each second data pins, the first data pins and the second data pins forming a plurality of low voltage differential pairs.

21. The receptacle of claim 9 wherein the first connector length is approximately equal to the sum of a standard ATA connector length and the second connector length.

22. A computer subsystem array comprising a disk drive and the receptacle of claim 9.

23. A computer subsystem array comprising a first computer subsystem, a host for the first computer subsystem, a receiver assembly, and the receptacle of claim 9 electrically connected with the first computer subsystem and coupled with the receiver assembly, which is further coupled with the host.

24. A computer subsystem array comprising a first computer subsystem, a second computer subsystem, a receiver assembly, and the connector assembly of claim 9 electrically connected with the first computer subsystem and coupled with the receiver assembly, which is further coupled with the second computer subsystem.

25. A receiver assembly for use in a connector assembly that facilitates electrical communication between a first computer subsystem and a second computer subsystem, the receiver assembly adapted to be coupled between the first computer subsystem and the second computer subsystem, the receiver assembly comprising a first row of substantially collinear spaced-apart first connector receivers;

a second row of substantially collinear spaced-apart first connector receivers, each first connector receiver having a first receiver depth; and a plurality of spaced apart second connector receivers each having a second receiver depth that is different than the first receiver depth, the second connector receivers being interspersed between and substantially collinear with the first connector receivers along at least one of the rows of first connector receivers so that each of the second connector receivers is positioned substantially between a corresponding pair of the first connector receivers to receive a corresponding set of second connectors that are positioned substantially between and collinear with a row of substantially collinear first connectors.

* * * * *